United States Patent [19]

Tattam

[11] 3,941,274

[45] Mar. 2, 1976

[54] BOX OR CASE

[76] Inventor: Francis Edward Tattam, Neild House, Beamond End near Amersham, Buckinghamshire, England

[22] Filed: June 6, 1974

[21] Appl. No.: 477,095

[30] Foreign Application Priority Data

June 15, 1973 United Kingdom ..... 28552/73
Sept. 20, 1973 United Kingdom ..... 44085/73

[52] U.S. Cl. ..... 220/62; 217/12 A
[51] Int. Cl.[2] ..... B65D 25/00
[58] Field of Search ..... 220/62, 6, 4; 217/12 R, 217/12 A, 13, 14

[56] References Cited

UNITED STATES PATENTS

| | | | |
|---|---|---|---|
| 956,512 | 5/1910 | Bender | 220/6 |
| 1,897,570 | 2/1933 | Bowman et al. | 229/30 |
| 2,025,420 | 12/1935 | Osgood | 217/12 R |
| 3,432,061 | 3/1969 | Anderson | 220/62 X |

*Primary Examiner*—William I. Price
*Assistant Examiner*—Steven M. Pollard
*Attorney, Agent, or Firm*—Cushman, Darby & Cushman

[57] ABSTRACT

A kit of parts constructed for ready assembly into a box and comprising a blank consisting of at least three juxtaposed side panels, a covering for each of the side panels, and end panels formed with projections and recesses for engagement with corresponding recesses and projections, respectively, on the side panels; wherein the covering is made of a repeatedly deformable elastomeric or sheet metal material, and each side panel, where adjacent to another side panel, is provided with projections and recesses which interlock with similar projections and recesses on the adjacent side panel. The kit is adapted to be assembled into box form by successive folding of the side panels into engagement with the end panels.

5 Claims, 11 Drawing Figures

BOX OR CASE

This invention relates to improved boxes or cases.

There have been many different proposals for collapsible and readily assembled boxes or cases, some of which have found commercial acceptance and large-scale use. However, as far as the applicant is aware, all commercially available boxes or cases have at least one, though usually several or all, of the following drawbacks: (1) erection or assembly is cumbersome and time-consuming or requires considerable physical effort so that women cannot be employed for the work; (2) special tools are required for assembly, for example, fastening lugs into slotted strips. Further, projecting parts, for example, grip lugs, may cause damage by tearing the clothing of a person handling the box or case; external feet or the like make it difficult to put bands around the assembled structure; and to protect the box or case against mechanical and thermal shocks and weather in storage or transit involves taking costly additional measures.

It is an aim of the present invention to provide several embodiments of boxes or cases that eliminate or reduce some or all the above disadvantages and which may be fabricated from inexpensive materials by simple methods and which, if desired, may be made to be repeatedly assembled and dismantled without using more than average physical effort and, in at least one preferred embodiment, without using special tools.

According to one aspect of this invention, there is provided a set or kit of parts constructed for ready assembly into a box or case comprising a blank consisting of three or four juxtaposed side panels and a repeatedly deformable covering to which each of the side panels is secured; and end panels (which may be separate or may also be secured to the covering), each of the end panels being formed with projections and/or recesses for engagement with corresponding recesses and/or projections, respectively, on the side panels. The side panels, where adjacent to each other, are also formed with such pairs of projections and/or recesses; the set or kit being adapted to be assembled into box form by successive folding of the side panels into engagement with the end panels.

The present invention extends also to boxes or cases when assembled from a set or kit of parts as set forth above.

The covering may be of a flexible elastomeric material, for example fabric, e.g. linen, backed rubber sheet, or of a plastically deformable metallic material, such as sheet aluminium; in each case there results a box or case that once made up may at will be collapsed again.

Used-up printing cylinder blankets may be used as the elastomeric covering, and used-up printing plates are a suitable and inexpensive form of aluminium sheeting. Thus these embodiments make very good use of materials otherwise considered as completely wasted.

In an advantageous embodiment, the flexible covering can be made up of a plurality of pieces, preferably two, in which case adjacent ends of the pieces are secured to the same side panel. In an alternative, however, the covering may be made of a single piece.

When used-up printing cylinder blankets, which comprise linen-backed rubber are used, it is preferred to use a suitable adhesive, e.g. an impact adhesive, to stick the linen side of the blanket to the bottom and sides, and optionally to the top, of the box or case. In a further alternative, the flexible elastomeric covering may be reinforced by incorporating metallic sheeting, e.g. aluminium sheeting derived from printing waste such as offset printing plates.

Expediently, the box or case is parallelopipedic with three or four oblong side panels secured to the covering and two end panels which may be generally square. Each side panel is then formed with a pair of spaced apart slots along each shorter side, and each end panel is formed with a pair of complementarily shaped tongues on each side thereof adapted snugly to engage in the slots either flush or so as to protrude therethrough. The tongues if protruding may then serve as feet for the assembled case or box. By providing a symmetrical arrangement of tongues and slots, a subsequent banding operation to put securing bands around the case or box is considerably facilitated and can be effected in two mutually perpendicular directions around each panel.

In this embodiment, with protruding tongues, the covering is also appropriately slotted so that its slots are aligned with those of the side panels and thus the tongues may project through the covering. It is then advantageous so to arrange the covering around the side panels as to produce an overhand or end flap. This flap may then be slotted also and may be secured around a pair of protruding tongues. If necessary, stapling may also be used better to secure the flap; on the other hand, the flap is by no means essential and may well be dispensed with for certain applications or uses of the invention.

Where a metal covering is used the tongues may be part of the covering. They may then be bent back on themselves in three substantially 90° bends so as to be wrapped around, and, tucked under, the associated edges of the panels. The metal blanket or covering is preferably made oversize in relation to the panels at each shorter edge of the latter and the "overhanging" portions are then bent back on themselves in the same way as the tongues. In this way, a particularly secure box construction results. Moreover, the construction provides increased security, since it is impossible so to bend and then re-bend the tongues and/or the "overhang" that these operations would not show. In other words, any unauthorised opening of the box would be immediately visible as the relatively soft metallic parts cannot re-assume exactly the shape into which they were first bent.

If desired, the end panels may also be provided with a covering, especially if extra protection or weatherproofing is desired.

In an alternative embodiment, each of the side panels are tongued and the end panels are slotted.

The surfaces of the panels intended to be the interior surfaces of the case or box may be provided with means, e.g. grooves, for accommodating partitioning or space-dividing members.

If it is desired to provide the erected case or box with one or more additional layers of covering for extra protection, the projections or tongues may be made longer so as to enable them to protrude through the slots of the additional covering layer(s).

In yet another improved embodiment, the case or box may be rendered fluid-tight by providing the inner faces of the panels with a suitable treatment or covering.

For carrying and transporting animals, the box or case may be provided with appropriate breathing apertures and the lid may be made of a transparent material.

Preferred materials for the sides or panels include laminated wood, or chipboard, or plywood, compressed paper or other paper-based product, or a "space frame" made up of wooden slats.

The wooden panels may also be made of waste: thus certain goods are in current commercial practice frequently delivered to the customer in "palletised" form and the load-carrying pallets are then thrown away by the customer. However, these wooden pallets can be used, in this invention, to produce the panels.

However, suitable plastics materials are also envisaged and generally speaking the choice of material is governed solely by considerations of cost and intended use.

When slats are used they may, according to a subsidiary feature of the invention, be built up into the frames by having a plurality of similar cross-slats cut to be a press-fit in recesses in the inward sides of edge slats shaped according to the position the frames will occupy in the finished box.

In one highly preferred embodiment, the panels are made up from the slatted space-frames and are provided with a double-skin or covering of "waste" aluminium sheeting on the outside and a single skin or covering on the inside. The result is a surprisingly light, yet surprisingly strong box or case that can be repeatedly assembled and dismantled.

The slats are of simple shape largely capable of being cut in stacks, for example by a suitable saw. Only recesses, or slots, require to be made by morticing or routing.

It will be self-evident that the shape of the projections (tongues) and apertures (slots) is arbitrarily selectable provided that they are of a complementary, tightly interengageable configuration.

Similarly, the said abutments and recesses may have any suitable shape capable of effecting the desired interlocking function.

Furthermore, it will be appreciated that the embodiment of the box or case with a flexible elastomeric covering need not include any metallic components such as hinges or fasteners. Whichever material is used the covering acts, in effect, as a hinge between adjacent sides, and interconnecting is by the interengageable projections and apertures. Moreover, no special tool is necessary for erecting the box or case from a collapsed state, in which state, the structure is conveniently flat and thus readily stackable or otherwise storable.

These advantageous features are in strong contrast to certain well-known and commercially available boxes or cases wherein adjacent sides are hingedly secured together by metal strips riveted to the sides, and wherein stiff metal tabs are provided on the sides to project through slots formed in the strips. These tabs must then be bent flat, e.g. by a blow from a hammer; such a method of assembly is not only time-consuming but is also considered unsuitable work for women.

The most important advantages of the box or case according to this invention lie in its strength, rigidity and light weight, and, where required, cheapness derived from using waste products and inexpensive materials. These advantages are achieved, moreover, without any attendant loss in strength of the assembled structure. Furthermore, printing words, slogans etc. on the panels is made considerably easier.

Three embodiments of the invention are described, merely by way of example, with reference to the accompanying drawings, wherein:

FIG. 1*a* is a plan view of an end panel for use in the box or case according to a first embodiment of the invention;

FIG. 1*b* is an end view, taken along the arrow B of FIG. 1*a;*

FIG. 2 is a plan view of the blank for use in the box or case according to FIG. 1;

FIG. 3*a* is a section taken on line 3—3 of FIG. 2 but on a greatly exaggerated scale, for the sake of facilitating understanding, while FIG. 3*b* is a section similar to FIG. 3*a* but of a variant showing a metal-covered box;

Figures 1A, 1B, 2, 3A, 3B:
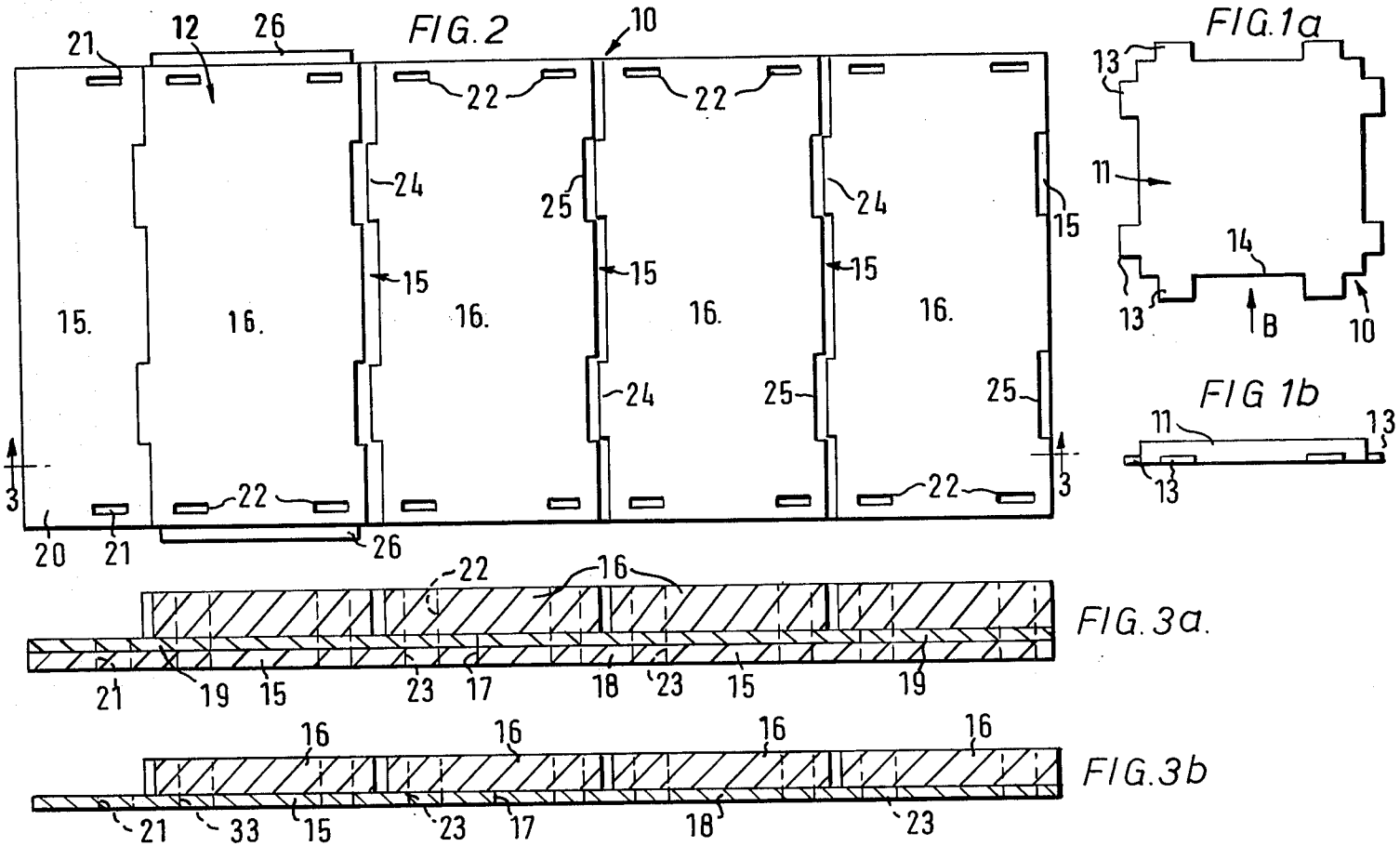
Figure 4:
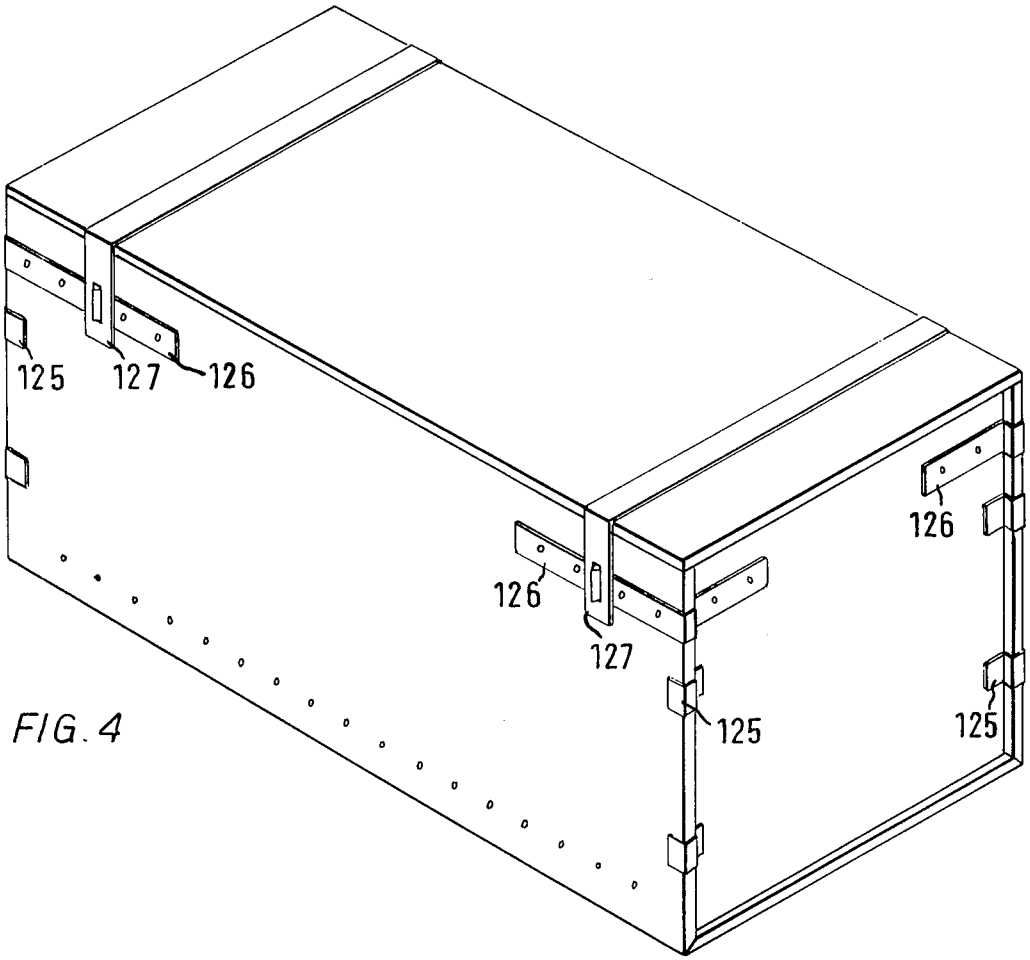
FIG. 4 shows an assembled box according to a further preferred embodiment of the invention.

Referring first to FIGS. 1 to 3*a* of the drawings, there is shown a box or case 10 (hereinafter box) comprising three main elements, viz. two substantially identical end panels 11 and a blank 12.

The end panels 11 each comprise a generally square wooden member having on each side thereof a pair of spaced apart, rectangular projections or tongues 13, the tongues 13 on one side 14 being somewhat longer than those on the other three sides, for reasons explained below. As can be seen from FIG. 1*b*, the tongues 13 are less thick than the thickness of the panel 11.

The blank 12 comprises a flexible covering 15 of sheet material like form and four oblong wooden panels 16. The panels 16 are mutually spaced apart but each is rigidly secured, e.g. by a suitable adhesive, to the covering 15.

In the illustrated embodiment, it is intended that the assembled box 10 should have a lid; however, if no lid is required, then the blank 12 would have three panels 16 only.

The covering 15 is shown in FIG. 3*a* as being made up of two pieces adjoining at 17 but, if desired, it may be a one-piece member or it may be made up of several pieces. In any case, it consists of an outer layer 18 of rubber secured to an inner or backing layer 19 of linen which itself may be interwoven with rubber filaments. Preferably, the covering 15 is made from pieces of waste printing cylinder blanket. This material has the known properties of good flexiblity, tremendous tear strength and inextensibility.

An end portion or flap 20 of the covering 15 extends beyond the panel 16 located at one end of the blank 12, and is slotted at 21.

Each panel 16 is formed at its shorter sides with a respective pair of spaced apart, through-going apertures or slots 22, and the covering 15 is formed with aligned slots 23, (FIG. 3*a*). The slots 21, 22 and 23 are shaped so as to receive as a snug fit a tongue 13 destined to project successively through the slots 22, 23 and slightly beyond the slots 23.

Moreover, each panel 16 is formed at one of its longer sides with a pair of spaced apart locking abutments 24 and at the other longer side with a pair of spaced apart recesses 25 of a shape complementary to that of, and adapted to co-operate with, the abutments 24.

The structure described so far may be speedily and simply erected into an assembled parallelopipedic box 10 by inserting the tongues 13 on one side of each end panel 11 into and through the slots 22, 23 of a panel 16 and the covering 15, respectively, then repeating this procedure with the other end panel 11 at the other pair of slots 22, 23 associated with the same panel 16.

Thereafter, the remaining panels 16 are folded about the first-mentioned panel 16 with the end panels 11 engaged therein to produce a closed box structure. In the erected state, the folding or hinging movement is limited by the interlocking of the abutments 24 of one panel 16 with the recesses 25 of the adjacent panel 16.

The end flap 20 of the covering 15 is then secured to the assembled structure by fitting its slots 21 around the tongues 13. The longer tongues 13 from side 14 will then serve as feet for the box.

The above description essentially applies throughout also to a construction shown in FIG. 3*b* where a metal covering e.g. of aluminium sheet, replaces the elastomeric covering, except that on all the panels of FIG. 2 an "overhang" is preferably provided as indicated at 26 for one panel, bent round the ends of the panels in the finished box.

It will be appreciated that the elements shown in the drawing may be fabricated in a simple manner, involving only straight saw cuts for the wood panels, except for the slots which are mortice-cut or routed.

The method of assembly may be facilitated further by first working out the final position of the longer tongues and then appropriately inserting the end panels into position. The whole folding operation may then be carried out in a single, continuous, unidirectional rolling motion.

In a non-illustrated variant, the tongues are made of a length such that on assembly they are flush with outer edges of the slots in the panels. Thus no corresponding slots need to be formed in the covering. If then it is desired to provide the box or case with legs, such legs may simply be stuck at the desired locations to be covering. The legs may e.g. be in the form of members resembling conventional rubber door-stops.

In another non-illustrated embodiment, the flap of the covering is made of double thickness by sticking another piece of linen-backed rubber to the existing flap, linen to linen, whereby both visible faces of the flap are of rubber. It is found that the inner rubber face of the flap will "stick" by friction to the outer rubber face of the covering on the side of the box or case to which the flap is to be secured. In this way, stapling is rendered unnecessary and any of the usual commercially available adhesive tapes e.g. scotch tape, can be used securely to fasten the flap.

Figure 5:
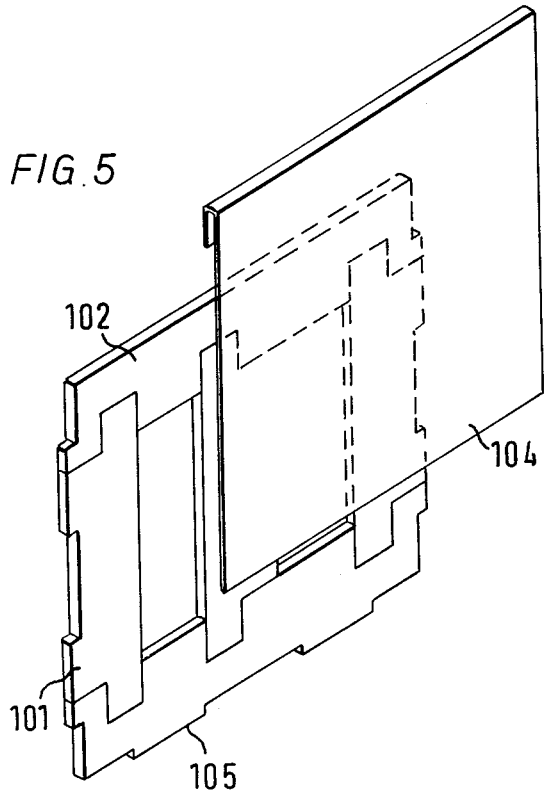
FIG. 5 shows a space frame for an end panel of the box of FIG. 4 and an inner skin for the panel.

Referring now to FIGS. 4 to 9 of the drawings, the box shown therein is built up of panels each of which has a so-called space frame of slats, e.g. 2 inches × ¼ inch softwood slats (approx. 5 cm × 6 mm), as seen in FIG. 5. The space frames consist of cross-slats 101, similar for all the panels, and edge slats 102 shaped according to the position they will occupy in the assembled box. The slats are cut to a light press fit into each other, for easy assembly into frames.

Figure 7:
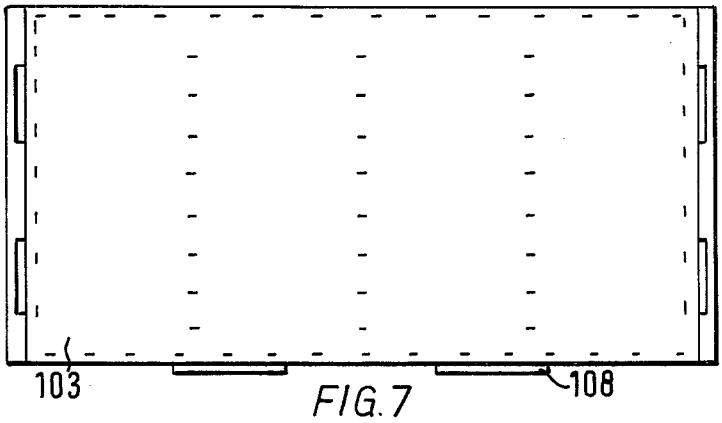
FIG. 7 shows a side panel, with stapling positions for an attached inner skin.

Each space frame is covered by an inner skin such as 103 in FIG. 7, stapled in position at approximately 1 inch (2.5 cm) centres and made of 28 SWG aluminium sheet (0.376 mm), and an outer skin of the same material. The outer skin of an end panel is shown at 104 in FIG. 5. Tongues 105 are formed integrally with the slats of the end panel space frames.

The base and side panels are very similar to each other. Both have slots 106 to receive the tongues 105, and recesses 107 are formed in the cooperating locking abutments 108 in the sides.

Figure 8:
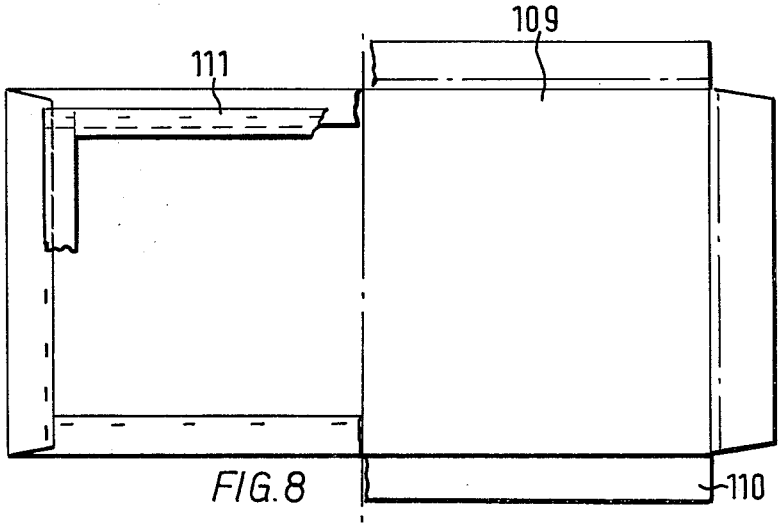
FIG. 8 is a composite, part-fragmentary view of a lid for the box of FIG. 4.

The lid has a space frame, not shown in FIG. 8, and an inner skin 109. The outer skin has flaps 110 bent and then stapled into position, as shown "before" and "after" in the right and left hand halves, respectively, of the Figure. Wooden locating slats 111 may, if desired, be glued or otherwise secured to the inner side of the lid, covering the lines of stapling.

Figure 9:
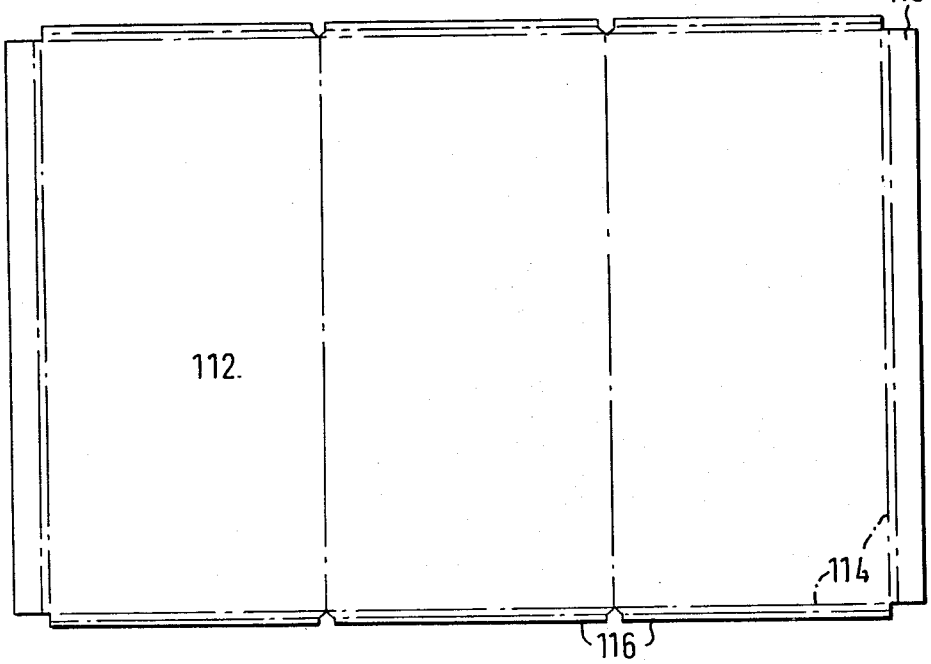
FIG. 9 shows an outer skin prior to attachment of the side and base panels to form the main blank of the box of FIG. 4.
Figure 6:
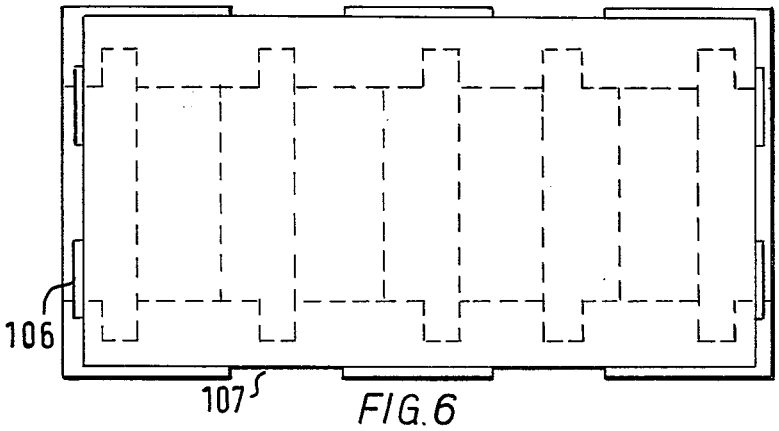
FIG. 6 shows a base panel for the box of FIG. 4, its space frame indicated by dotted lines.

To form the main blank of the box, the outer skin 112 of FIG. 9 is first stuck or otherwise secured to a rectangular secondary skin, of the same aluminium sheet, within the lines 114 of the Figure. The side and base space frames complete with the inner skin 103 are then stuck or otherwise secured in position with the edges carrying the recesses 107 and locking abutments 108 spaced by the thickness of the slats apart, as in FIG. 2, and the flaps 115, 116 are then bent over and stapled.

To assemble the box the exposed wooden parts of the end panels are coated with glue, if desired, and the appropriate tongues of the end panels are set into the slits of the base panels of the main blank. The side panels of the blank are then bent gently up until the locking abutments and recesses, and the rest of the tongues and slots engage, and are clamped in position by clips.

Finally spring steel strengthening clips 125 (FIG. 4) are pressed on; pre-drilled lid mounting straps 126 are placed in position and rivetted on after drilling the base; and the lid is placed in position and retained by removable spring steel clips 127.

In a non-illustrated variant of any of the above-described embodiments, the base panel of the box as well as at least the lower parts of the adjacent side and/or end panels may be provided with an additional elastomeric covering of the kind described in connection with the embodiment of FIGS. 1 to 3*a*. This variant is particularly useful where the box is likely to be exposed to excessive wear at the base due to dragging, scuffing etc. The upper ends of the covering can be secured in any suitable manner, e.g. with the aid of the clips shown in FIG. 4.

I claim as my invention:

1. A collapsible assembly of panel members capable of being readily assembled into a transport box for the storage and transport of relatively heavy cargo therein and capable of being disassembled into a flat for the efficient storage thereof comprising a blank member including at least three rigid side panels engageably spaced with respect to one another and a flexible supporting cover to which said rigid side panels are fixedly secured in said spaced relationship, said side panels being disengaged when said blank member is substantially flat, said side panel members having complementary projections and recesses adjacent one another and said projections and recesses having a depth dimension equal to the thickness of said panel members, said projections and recesses of each panel member lockingly engaging one another in mutually supportive perpendicular directions when said blank member is folded into a box, and a pair of end panels having a plurality of projections engageable with complementary recesses in the ends of said side panel members, said projections of the end panels having a depth dimension at least equal to the thickness of said side panels.

2. The collapsible assembly of claim 1 wherein said supporting cover includes a flexible elastomeric material.

3. The collapsible assembly of claim 1 wherein said flexible supporting cover includes a plastically deformable shape retaining metallic material.

4. The collapsible assembly of claim 1 wherein said end panels are covered with said flexible supporting cover material.

5. The collapsible assembly of claim 1 wherein at least some of said panels include a frame of interlocked slats, each of said slats being covered by two layers of metallic sheeting on one side and a single layer of metallic sheeting on the other side thereof.

* * * * *